United States Patent [19]

Jasser et al.

[11] Patent Number: 4,953,915

[45] Date of Patent: Sep. 4, 1990

[54] ROOF FALL SEPARATING AND REMOVING APPARATUS AND METHOD FOR USE IN THIN SEAM HIGHWALL MINING

[75] Inventors: Manfred Jasser, Versailles; Thomas Lipinski, Winchester, both of Ky.

[73] Assignee: Metec, Inc., Lexington, Ky.

[21] Appl. No.: 387,621

[22] Filed: Jul. 31, 1989

[51] Int. Cl.[5] ..... E21C 35/20

[52] U.S. Cl. ..... 299/18; 198/860.3; 198/735.1; 299/64; 299/68

[58] Field of Search ..... 299/1, 18, 64, 67, 68; 198/735, 860.3, 860.5

[56] References Cited

U.S. PATENT DOCUMENTS

| | | | |
|---|---|---|---|
| RE 24,004 | 5/1955 | Howard | 299/68 |
| RE 31,622 | 7/1984 | Todd | 299/1 |
| 1,445,230 | 2/1923 | Morgan | 299/65 |
| 1,681,089 | 8/1928 | Bottomley et al. | 198/514 |
| 2,978,235 | 4/1961 | Felbeck et al. | 289/56 |
| 4,082,362 | 4/1978 | Justice et al. | 299/57 |
| 4,205,881 | 6/1980 | Nitzberg | 299/18 |
| 4,568,126 | 2/1986 | Nitzberg | 299/1 |

*Primary Examiner*—Jerome W. Massie

*Assistant Examiner*—David J. Bagnell

*Attorney, Agent, or Firm*—Wood, Herron & Evans

[57] ABSTRACT

A thin seam highwall mining machine has a cutter head for mining coal from a seam while advancing forwardly into a mined hole, a power head anchored to a bench at the surface, and multisection pushbeam extending therebetween housing a conveyor therein. The machine is provided with structure for removing fallen roof rock from the hole and preventing jamming of the machine in the hole by rock accumulation. The structure includes a partition which keeps the fallen rock from mixing with the mined coal, and guide members which direct fallen rock onto the conveyor from the partition as the machine is being withdrawn from the hole. A pair of upstanding rearwardly diverging guide members fixed to the partition direct rock onto the conveyor through an opening in the partition overlying the forward end of the conveyor. One of the guide members carries an advancing conveyor surface having rock advancing bits which rotate and crush the rock while advancing it toward the opening. The pushbeam conveyor includes counter-rotating augers with rock crushing bits thereon which further crush the rock as it is removed.

31 Claims, 5 Drawing Sheets

ROOF FALL SEPARATING AND REMOVING APPARATUS AND METHOD FOR USE IN THIN SEAM HIGHWALL MINING

The present invention relates to highwall mining machines for the mining of coal seams by remote control, and more particularly, to a method and apparatus for separating and removing roof fall to prevent the jamming of highwall mining machines in the mined hole of the coal seam.

BACKGROUND OF THE INVENTION

Highwall mining is a procedure for extracting coal or other mineral from a seam with remote control machinery which extends into the seam from a bench at the surface of a highwall. A highwall is a vertical or steeply sloped face of an excavation which has been cut on a mountain side or has been exposed by the digging of a pit in the course of a surface mining operation. The portion of the seam which has been removed by the mining excavation will leave a relatively flat and generally horizontal surface at the base of the highwall referred to as the bench. As a result, at the base of the highwall will be found an artificial outcrop of coal or other mineral underlying an overburden of soil and rock. From the outcrop a continuation of the mined seam will extend into the earth or under the mountain.

The creation of highwalls is in part due to the economic factors involved in strip mining. The cost of exposing and removing coal from a seam is related to the amount of overburden which must be removed to expose the seam. As the surface mining operation progresses, if the overburden progressively thickens, it eventually ceases to be economical to continue surface mining. This is because the amount of overburden material which must be removed per given amount of coal recovered reaches a ratio at which it is no longer cost effective to proceed. As a result, the seams of the coal remaining beyond the face of the highwall must be mined, if at all, by other techniques.

With seams of this type, the thickness is frequently too small to allow the mining to be economically carried out by miners working within the seam. Often, the seam may be no more than two to three feet in thickness. For this reason, the art of highwall mining is undertaken by the use of remote control machinery.

Early efforts to mine a coal seam from a highwall included the use of coal augers to bore circular holes in the coal seam. Auger mining was employed to mine coal seams from benches cut in mountainsides or left from surface mining operations. These auger devices, however, made poor utilization of the natural coal. Often the coal removed was contaminated with material from outside the seam since there was no effective method for guiding the advancing auger.

Other developments in highwall mining involved the use of continuous mining machines which were remotely controlled to proceed into a coal seam. These machines were followed into the mined hole by open conveyor vehicles which removed the coal to the surface. Such devices, as for example one referred to as the Push Button Miner developed by Joy Manufacturing Co., were only marginally effective. They experienced a serious problem of the expense of recovering machinery after roof falls during mining and they were unable to accommodate the wide variety of roof conditions encountered. Accordingly, this prior method has been practically abandoned.

Furthermore, mining techniques which employ open conveyors to transport the mined coal from the seam to the surface also allow the rock which falls from the roof to fall onto the conveyor to be removed with the coal. This fallen roof rock, so removed, contaminates the coal, increasing its ash content and thus reducing its market value.

More recent developments in highwall mining machines have been more successful. One such machine is disclosed in U.S. Pat. No. Re 31,622 issued to Robert E. Todd. Machines such as those shown in Todd Reissue Pat. No. 31,622 represent a substantial improvement over prior equipment and methods for mining thin seams from a highwall.

The Todd miner includes a cutter head which is driven into the coal seam by a rectangular compression beam which is assembled in sections behind the mining head and is thrust from a baseframe at a bench outside of the mined hole at the surface of the highwall. The mining head is similar to that of a continuous mining machine. Such machines permit deep entry into the coal seam, efficient recovery of resources and economical production of coal.

However, even though the Todd highwall miner has been constructed with a relatively smooth profile to aid in its extraction from the mined hole, in areas where the overburden is unstable, the operation of such miners has been hampered by roof material falling upon the cutter head and upon the pushbeams. After falling upon the equipment, such material will continue to rest upon the pushbeams and accumulate as the cutter head advances to its maximum extent into the seam. Then, as the mining machine is retracted from the mined hole, the fallen material resting on top of the pushbeams has a tendency to snag against the roof as the beams are extracted from the hole.

The height of the pushbeams is a minimum height sufficient to resist bending and house an adequately sized conveyor within. The cutter head is often larger than the pushbeams, especially at its forward end. Thus the snagged roof material on top of the pushbeams has a tendency to jam against the cutter head as it is withdrawn. As a result, removal of the equipment can result in damage to the cutter head or to the pushbeams or to various components of the machine. With newer, wider and more efficient cutter heads, roof falling tends to be a greater problem. Higher cutting rates and increased power permit cutting outside the seam and often results in a less smooth profile. As a result, the problem of jamming due to fallen roof material has become an increasing problem.

Because it is quite common to find a layer of unstable slate or shale overlying a seam of coal, the problems of roof fall into the mined holes in coal seams is a common problem. Often, the rock overburden which falls does so in relatively large sections of, for example, one or two meters across. As such, the tendency of fallen rock to jam the equipment is serious and the ability of the equipment to crush the fallen roof material so as to free the equipment has been ineffective or extremely time consuming.

The pushbeams of the Todd miner include a rectangular housing with a conveyor located within. The conveyor is in the form of a pair of rotating augers which transport the mined coal to the surface. These augers are of the type having spirals corresponding in direction to the direction of rotation so as to move material toward the surface at the highwall.

Any jamming of the mining machine in a mined hole results in a delay in extracting the machine and hence in a loss of the use of the equipment and a loss of time of the personnel operating the equipment or otherwise assisting in the mining operation. As a result, any jamming which occurs increases the mine cost of the coal.

Accordingly, there has been and remains a need to remove fallen roof rock from the surface of the miner, and to do so in such a way as to prevent its jamming of the mining equipment in the hole and to avoid contamination of the coal with the fallen rock.

SUMMARY OF THE INVENTION

It is a primary objective of the present invention to improve the economics of mining with a highwall mining machine, particularly where the laminar overburden overlying the coal seam is unstable. It is a particular objective of the invention to improve the economics of mining coal with a highwall thin seam miner by substantially reducing the time requirement to extract the machine through the substantial elimination of jamming of the equipment in the mined hole.

It is a further objective of the present invention to provide apparatus for maintaining the fallen roof material separate from the mined coal which is being transported to the surface. It is a more specific objective of the present invention to prevent damage to the mining equipment and to minimize the likelihood of a jamming of the equipment by removing the fallen roof material from the coal seam. More particularly, it is an objective of the present invention to remove the fallen roof material in such a way that it will remain separated from the mined coal being removed.

It is a still further objective of the present invention to provide a means for breaking the fallen roof material so that it is less likely to jam or fatally trap the cutter head within the mined hole and to thereby facilitate the removal of the rock and the mining equipment from the mined hole.

According to the principles of the present invention, a mining machine is provided with a cutter head which mines coal as it advances forwardly into the coal seam. The head is mounted at the forward end of a conveyor assembly which removes the mined coal to the surface as it advances into the seam. The conveyor assembly carries a partition on its upper surface to maintain separate from the conveyed coal roof rock which falls as the machine advances. Guide members are provided above this partition to direct the fallen rock into the conveyor when and only when the machine withdraws from the mined hole. In accordance with the preferred and illustrated embodiment of the invention, a highwall mining machine is provided with a baseframe situated on a bench at the surface of the highwall, a cutter head adapted to thrust the cutter head into a coal seam, and an interconnecting multi-section pushbeam extending from the bench to the cutter head to exert compressive force by which to drive the cutter head into the seam. Housed within the pushbeam is a conveyor to remove the mined coal from the seam to the surface. The invention provides that the pushbeam include a housing having an upper surface sufficiently smooth and of sufficiently strong to support thereon fallen roof material expected to be encountered during the excursion of the mining into a coal seam.

At the forward end of this upper surface, an opening is further provided by which fallen roof rock may enter the housing onto conveyors carried therein so the conveyors can function to transport the rock to the surface when the machine is retracted from the seam. The opening in the housing is positioned ahead of the separator surface so that rock fallen upon the partition surface is either pushed away from the hole or remains stationary on the partition during the advancement of the cutter head and while the conveyor within the push beam housing is operative in removing coal to the surface. The position of the opening is also such that, as the equipment is being retracted from the coal seam, subsequent to the mining of coal and following removal of the coal through the conveyor within the housing, the fallen roof rock will be pushed, as it drags against the roof of the seam, toward the opening.

More particularly provided, according to the preferred embodiment of the present invention, is an upstanding guide assembly consisting preferably of a funnel-like pair of upstanding guide members having inwardly facing conveyor surfaces extending from adjacent the opening on each side thereof and diverging rearwardly from the opening spanning at the rearward end the approximate width of the pushbeam. These rearwardly diverging surfaces funnel, from the separator surface and into the opening, the fallen roof material which has snagged on the roof as the equipment is withdrawn from the hole.

In accordance with a preferred embodiment of the present invention, the guide assembly includes mechanical advancing mechanism which urges the fallen roof rock toward the opening. Preferably, the advancing mechanism is in the form of continuous belt or chain with a plurality of bits or dogs projecting therefrom to advance the rock toward the opening. The dogs on the inside surface of the advancing mechanism push the rock relative to the housing surface at a speed which is greater than the speed at which the housing is being withdrawn from the seam so as to loosen the rock from the roof.

The advancing mechanism is preferably on only one of the guide surfaces. As such, the dogs or bits will have a tendency to rotate slabs of fallen roof material against the opposing upstanding stationary guide to break and crush the slab as the guides converge toward the opening while the fallen rock is being advanced thereto. In this way, the fallen roof rock, which often falls in large sheets, will be broken to a size which will permit the rock to fall through the opening to the conveyor within the housing.

In accordance with further principles of the present invention, the conveyor within the housing consists of a pair of counter-rotating oppositely spiraled augers which carry at the forward section thereof rock crushing teeth. The teeth are positioned at the tips of the spiral auger blades to further break the rock as it enters the auger conveyor so that the rock is reduced to a size to be easily conveyed through the auger conveyor to the surface.

The advantages provided by the present invention are that the fallen roof rock is maintained separate from the coal which has been mined and is being removed from the surface, and, without the need of additional expensive or exotic equipment, the fallen roof rock is broken up and transported from the coal seam. The rock is removed from the seam surrounding the housing where it tends to jam the equipment in the seam, and is transported through the same auger conveyor which transports the coal to the surface of the highwall. This transporting of the fallen roof material is performed after the transporting of the coal to the surface so that the removal of the rock and removal of the coal do not result in a mixing of the rock with the coal, and accordingly does not result in contamination of the coal with the rock.

The invention is effective to loosen jammed rock which overlies a housing and has fallen from the seam roof to prevent jamming of the equipment in the seam and to prevent a loss of valuable time during the withdrawal of the mining head from the mined hole of the coal seam. As a result, the life of the equipment is increased due to an elimination of the highly damaging and destructive jamming which may otherwise occur. The time saved by the present invention in the use of the equipment and the manpower needed to free jammed equipment reduces the overall price of the mined coal. As a result, the efficiency of the coal mining operation is improved and the overall price of the mined coal from the thin seam highwall mining operation is lowered.

These and other objectives and advantages of the present invention will be more readily apparent from the following detailed description of the drawings in which:

DETAILED DESCRIPTION OF THE DRAWINGS

Highwall mining machines of the type to which the present invention relates are those such as the thin seam mining machine described in detail in Todd U.S. Reissue Pat. No. Re 31,622 which is hereby expressly incorporated into this specification by reference. The features of the highwall mining machine are described more fully in connection with FIG. 8 below. The present invention includes a structure carried by the cutter head assembly of such a thin seam mining machine. A cutter head assembly or cutter head module constructed in accordance with a preferred embodiment of the present invention is illustrated and more fully described in detail in connection with FIGS. 1–3.

Figure 1:
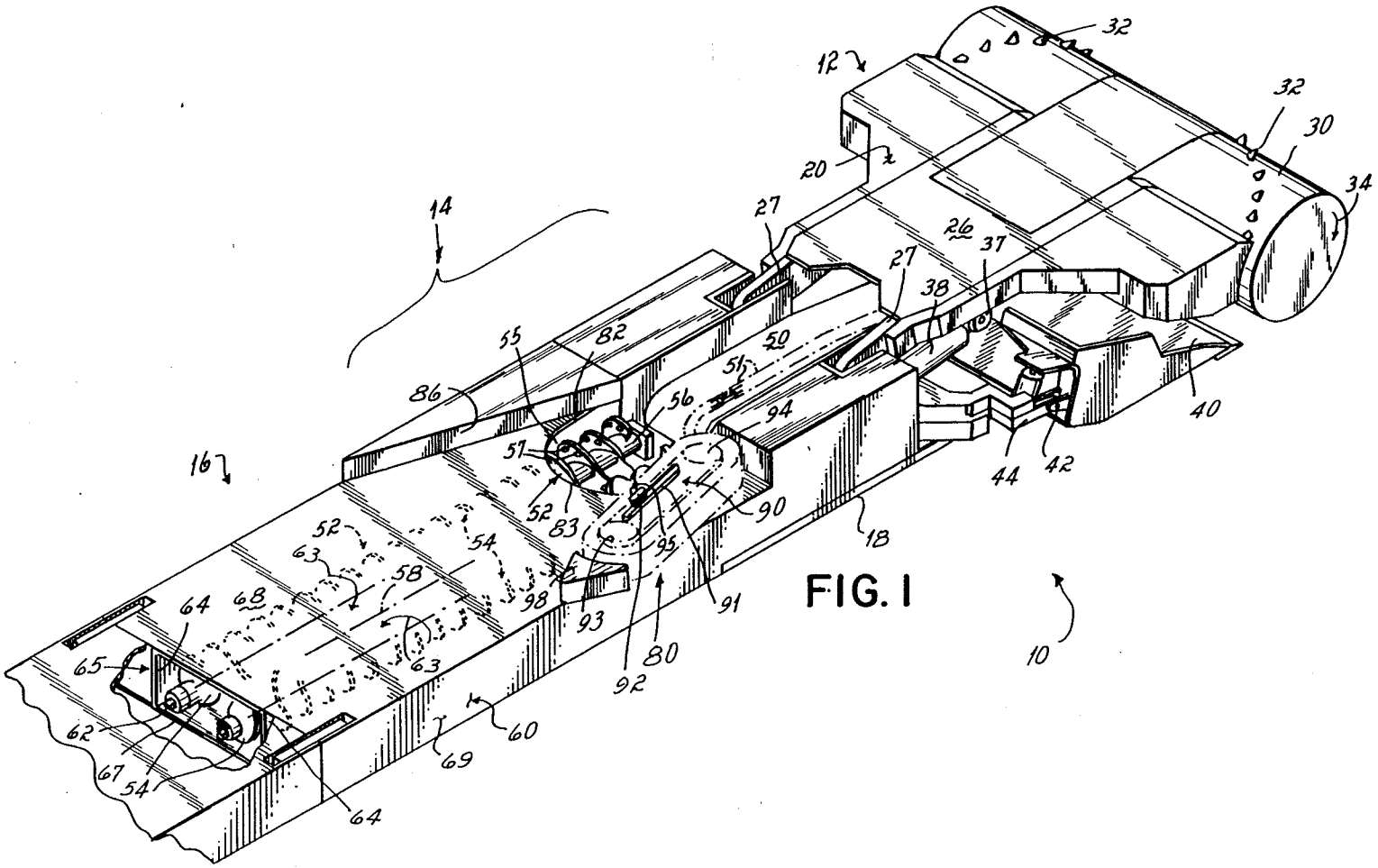
FIG. 1 IS an isometric drawing illustrating the cutter head module for a highwall mining machine provided with a preferred embodiment of the roof rock removal apparatus according to principles of the present invention.
Figure 2:
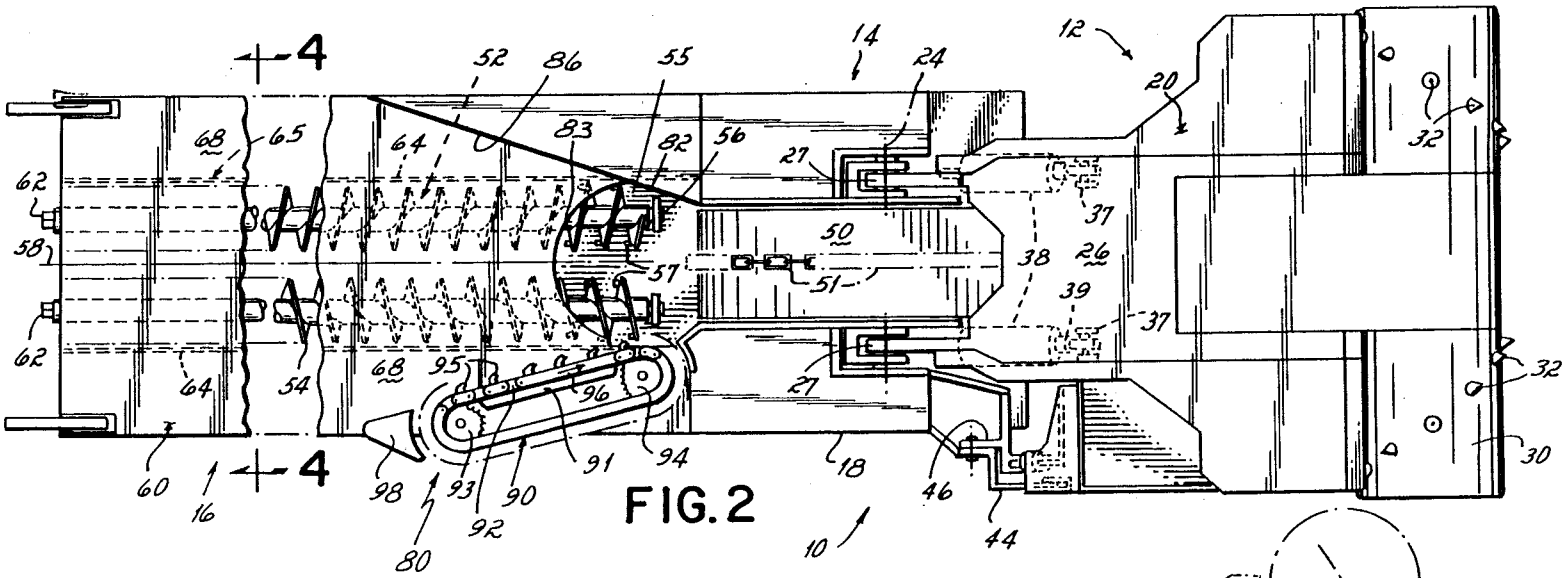
FIG. 2 is a top view of the cutter head module of FIG. 1
Figure 3:
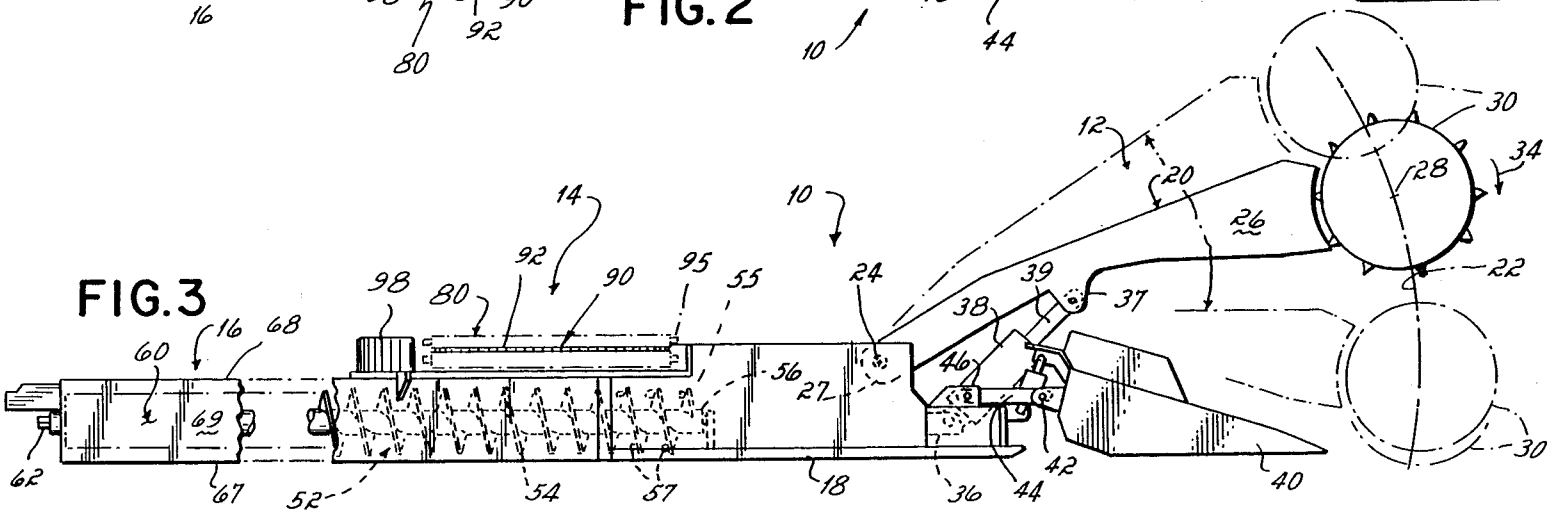
FIG. 3 is a plan view of the cutter head module of FIG. 1.

Referring to FIGS. 1–3, a cutter head module 10 of the highwall mining machine is illustrated. The cutter head module 10 is the forwardmost of several modules which make up a highwall mining machine. The module 10 of FIG. 1 includes a front portion 12, a midportion 14 and a rear portion 16. The front, middle and rear portions 12, 14 and 16, respectively, of the cutter head module 10 are joined together by a rigid steel frame 18.

The front portion 12 of the cutter head module 10 includes a cutter boom assembly 20 which may be generally of a type employed in any one of several conventional continuous mining machines. The cutter boom assembly 10 of the illustrated embodiment is pivotally attached to the frame 18 so as to move in an arc 22 in a vertical plane about a horizontal transversely disposed axis 24 at one end of a boom arm 26. Mounted to the cutter boom assembly 20 so as to pivot about a horizontal transverse axis 28 at the free end of the boom arm 26 is a cylindrical cutter drum 30. The cylindrical surface of the cutter drum 30 carries a plurality of cutter bits 32 which are arranged in a pattern to efficiently cut coal from the face as the drum 30 rotates.

The cutter boom arm 26 is a forked arm which includes a pair of arm sections 27, 27 spaced on opposite sides of the frame 18 to pivot on the frame 18 about the axis 24. Below each one of the cutter boom arm sections 27 is a respective one of a pair of brackets 36, 36 each rigidly extending from the frame 18. A further pair of brackets 37, 37 are formed on the underside of the cutter boom arm assembly 26 one on each of the arm sections 27. Connected between each of pairs of brackets 36 and 37 is a hydraulic piston assembly 38 having a cylinder end pivotally connected to the bracket 36 on the frame 18, and having a piston rod 39 pivotally linked to the bracket 37. The hydraulic piston 38 operates to raise and lower the cutter boom arm 26 to pivot it about the axis 24 to thereby raise and lower the cutter drum 30 along the arc 22.

The cutter head boom assembly 20 and the related components of the front portion 12 of the cutter head module 10 function in the same manner as the cutter head on a conventional continuous mining machine. A number of different cutter head configurations are used with thin seam mining machines of the type to which the present invention relates. The particular configuration most suitable for a given application is determined by a number of factors, one of which is the thickness of the coal seam and the appropriate width of the mined hole to be cut. Some such cutter heads are hydraulically driven and others are electrically driven. Based on present technology, the larger cutter heads are of the electrically driven type due to their ability to develop greater torque and power while the smaller heads are often of the hydraulically driven type due to their ability to develop adequate power in a more confined space.

Because the problems to which the present invention is directed are more likely to occur and are more acute with larger and wider mined holes, the present invention is described in connection with an electrically driven power head, and more specifically, one of a type well known to those skilled in the art and manufactured by Joy Manufacturing Company as Joy Model 14CM. Accordingly, the cutter boom 20 described in connection with the illustrated embodiment is of the type which may be purchased as Joy Model 14CM.

Such a cutter boom assembly 20 includes an electrical cutter drum drive (not shown) contained within the cutter head assembly 20 which rotates the drum 30 in the direction 34 to cut coal from the face of the seam as the drum 30 advances into the coal seam. Coal, when mined, drops beneath the drum 30 to the floor of the mined hole at the base of the leading forward wall of a mined hole which is being cut by the drum 30. The mined coal which drops to the floor of the mined hole beneath the cutter drum 30 is gathered by a gathering head or gathering pan 40. The gathering head assembly 40 is pivotally connected about a horizontal transverse shaft 42 at its rear end to linkage 44 which is in turn pivotally linked to a bracket 46 on the frame 18. The weight of the gathering pan 40 is pivotally supported away from the floor of the mined hole by a spring assembly 48 connected between the frame 18 and a link 49 at the upper rear end of the gathering pan 40. The amount of support is varied to permit proper cleanup without excessively digging into the mined floor. The gathering pan 40 is a conventional type having gathering arms (not shown) therein which gather the coal onto the pan 40 and advance it to a gathering conveyor 50 of the endless chain type which moves the mined coal rearwardly between the arm sections 27 of the cutter boom arm assembly 26 from the forward portion 12 of the cutter head module 10 to the midportion 14 thereof.

At the midportion 14 of the cutter head module 10, the endless conveyor belt of the gathering conveyor 50 is driven by conveyor drive means (not shown) which includes a foot shaft, located in the gathering head and drivably connected between drives for each of the gathering arms, which drives the conveyor, transmits power between the gathering arms and synchronizes the two arms. The conveyor 50 is an endless lugged chain 51 having a plurality of transverse bars thereon for advancing the coal rearwardly from the forward section 12 of the module 10 to the midsection 14 as the conveyor 50 is driven. The conveyor 50 delivers the mined coal to the forwardmost portion of a horizontal auger material removal conveyor 52 which extends through the pushbeam string beyond the surface of the highwall as is explained more fully below.

Referring also to FIG. 3, the conveyor 52 includes a pair of multi-section counter-rotating and counter-spiraled augers 54, the forwardmost sections 55 of which are housed within the rearward section 16 of the module 10 and supported at their forward ends 56 by bearing assemblies (not shown) carried by the frame 18. This rearmost section 16 of the cutter head module 20 joins the forwardmost section of a pushbeam and conveyor string as will be described more fully below. The pushbeam string functions to transfer to the cutter head module 20 the force to advance it into and withdraw it from the mined hole as developed by a power head at the surface. As a conveyor assembly, the structure functions to remove material directed into the conveyor to the surface of the highwall.

Referring to FIG. 1, the augers 54 of the conveyor 52 are symmetrically positioned on opposite sides of a center line 58 of a forward beam housing section 60. Referring again to FIG. 3, the housing section 60 has a rectangular cross-section and rigidly connected to the frame 18. The forward section of the auger conveyor 52 extends longitudinally from its forward end 56 through the housing 60 to drivably connect at its rearward end 62 to the section of the auger conveyor 52 within the next successive beam module as will be explained more fully in connection with FIG. 8 below. The augers 54 are also supported to the housing 60 near the rear end 62 thereof by bearings (not shown) carried by the housing 60.

The housing 60 encloses the conveyor 52 at the rear section 16 of the module 10. Referring to FIG. 1, the housing 60 has a pair of vertical inner walls 64 spaced on each side of the augers 54 which form a rectangular channel 65 about the augers 54 in cooperation with a lower housing surface or plate 67 and an upper housing surface or plate 68. Both of the augers 54 rotate upwardly along the centerline 58 in a direction shown by the arrows 63 in FIG. 4. The outside of the housing 60 presents a smooth box-like shape defined by the lower housing surface 67, the upper housing surface 68 and a pair of exterior side housing plates 69. The surfaces 67, 68 and 69 define the rectangular exterior cross-section of the housing 60. The coal transporting channel 65 of the conveyor 52 is also rectangular and is defined by the smooth surfaces 64, 64, 67 and 68.

During the mining of coal, the gathering conveyor 50 delivers and deposits the coal from the cutter head onto the forward end of the horizontal auger conveyor 52 in the vicinity of the auger ends 56 from where the coal is transported by the rotation of the augers through the rectangular channel 65 to the surface of the mined hole.

As FIGS. 1–4 demonstrate, the external walls 67, 68 and 69, 69 of the housing 60 have a smooth and regular shape. This facilitates the removal of the mining machine cutter head module 10 from the mined hole.

The principal problem to which the present invention is directed can be described with reference to FIGS. 9–11. Loose rock which would fall from the roof of the mined hole will rest upon the upper surface 68 of the housing 60 as the mining machine is advancing into the mined hole. The same is true as the mining machine retracts. When the machine is moving in the forward direction, these rocks have only a small likelihood of wedging between the irregular surface of the mined hole and the surfaces of the housing 60. The likelihood that the rocks will jam against the cutting boom assembly 20 is, however, much greater.

As will be seen by reference to FIG. 3, for example, the frame 18 as well as the other components of the forward section 12 of the cutter head module extend upwardly above the upper housing surface 68. This is necessary in that, for efficient mining operation, the cutter drum 30 will be selected, along with the other components of the cutter boom assembly 20 which support it, to be of such size as will be accommodated by the thickness of the seam to be mined and thus the minimum height of the mined hole. In that way, mining can proceed forward quickly with less need to sweep the drum 30 along the arc 22. The height of the housing 60, however, will be the height of the conveyor 52. This height will be typically approximately 20". This height is a minimum height so that the multiple conveyor sections can be used for a variety of mine seam heights as might be found in the field.

Figure 5:
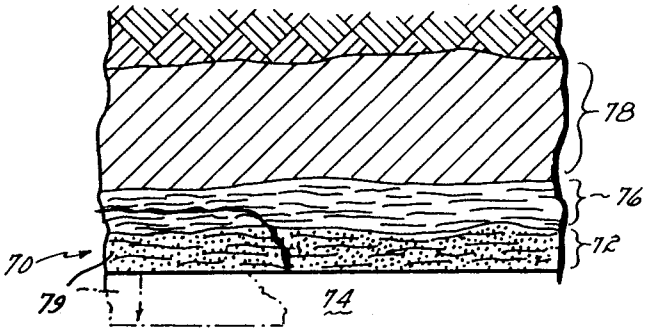
FIG. 5 is a cross-sectional diagram through a coal seam illustrating the geological problems associated with the roof of the mined hole which causes in part the problem with respect to which the present invention is directed.

The falling of the roof rock which results in the problem to which the present invention is directed is illustrated in part in FIG. 5. FIG. 5 shows a cross-section through the roof 70 of a mine seam. This roof will typically include a thin layer 72 of unmined coal which will overlie a mined hole 74 which has been cut by the cutter drum 30 of the cutter head module 10. The coal seam itself will often be found to underlie a layer of sedimentary rock, often slate or shale, 76. One characteristic of this type of rock is that it is formed in layers loosely joined which parallel the roof 70 of the seam. Its layers thus easily become separated when the support beneath them is removed. Cutting of the mined hole 74 removes such support.

In typical highwall mining applications it has often been found that immediately overlying the slate or shale layer 76 is another layer of harder more cohesive rock 78. This may be sandstone or limestone. With mined holes cut by thin seam miners, the hole 74 is usually designed to be not of such width that the harder rock which forms the layers 78 would collapse due to lack of support. The layer 76 does, however, frequently flake from the roof in the form of plate-like rock fragments 79 and falls on the top of mining equipment which passes beneath during the cutting of the mined hole 74. While the equipment continues to advance, this rock usually remains in place on top of the pushbeams onto which it falls.

In contemplation of this, in accordance with the present invention, the upper housing surface 68 is made of the strong sheet steel material sufficient to adequately support the fallen rock fragments 79 without being damaged thereby. When the mining equipment is withdrawn from the mined hole 74, however, these fallen rocks 79 may bind against the roof 72 and serve as an obstacle to the removal of the taller and more irregular forward and central portions 12 and 14, respectively, of the cutter head module 10. In order to clear the rock and prevent a jam of the equipment in the mined hole 74, a roof rock removal assembly 80 is provided.

According to the preferred embodiment of the present invention, a roof rock removal assembly 80 includes an opening 82 at the forward end of the upper housing surface 68 on the housing 60 at the extreme forward end of the rear section 16 of the cutter head module 10. The opening 82 overlies the forward ends 56 of the augers 54 and forms the sole path of communication between the minded hole 74 and the channel 65 of the conveyor 52. The opening 82 permits rock fragments 79 under which the housing 60 is pushed, upon retraction of the equipment from the mined hole 74, to fall into the conveyor 52. As such, the housing surface 68 effectively serves as the separating partition which maintains the fallen rock 79 separate from coal which is being transported through the conveyor 52 during the advancement of the cutter head module 10 into the coal seam.

The opening 82 is partially circular in shape having a generally half circular downstream end 83 and a straight upstream end defined by a transverse cord of the circle at the discharge end of the coal gathering head conveyor 50.

Figure 6:
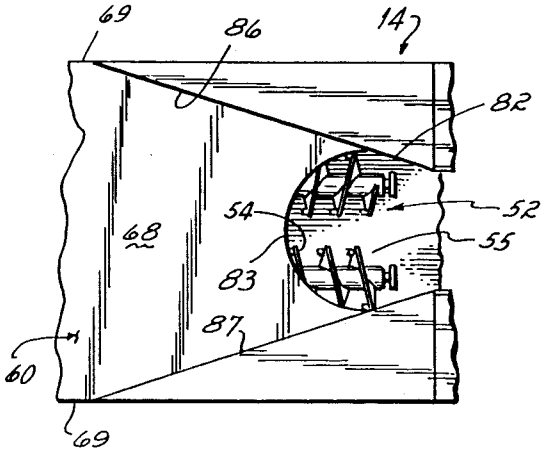
FIG. 6 is a plan drawing illustrating a portion of the rock removal feature of the present invention similar to FIG. 2 but in an alternative embodiment.

Referring to FIG. 6, rearward of the opening 82, the assembly 80 is provided with a pair of diverging upstanding guides 86 and 87 rigidly attached to the upper housing surface 68 in a general backwardly facing V-shape. One of the simpler embodiments of this assembly 80 is illustrated in FIG. 6. There, the two guide surfaces are stationary upstanding vertical plates 86 and 87, each rigidly secured to the upper surface 68 of the housing 60, and inclined to guide rock into the opening 82 in funnel-like fashion. This guiding takes place to deliver rock into the opening 82 as the cutter head module 10 is withdrawn from the mined hole 74 wherein the wide end of the funnel is at the leading end of the guide. The rocks entering the funnel will thus be directed into the opening 82. Where the rock fragments 79 are large, however, the rock may still have a tendency to wedge between the surfaces 86 and 87. In order to overcome such a potential problem one guide plate 87 is replaced with a rock advancing and crushing assembly 90. This preferred embodiment is illustrated in FIGS. 1–4.

The rock crushing assembly 90 includes a rock advancing chain 92 mounted upon and driven by a pair of sprockets 93 and 94, each rotatably mounted to the upper housing surface 68. A longitudinal chain "back-up" brace 91 spans the area between sprockets 93, 94. One of the sprockets 93 or 94 is a driven sprocket driven by motor (not shown) contained within the housing 60. The other sprocket, 94 or 93 is an idler sprocket. The chain 92 includes the series of rock crusher bits 95 spaced along the periphery of the chain 92. The chain 92, when in operation, is driven in the direction of the arrow 96 as shown in FIG. 2. The linear speed of the drive of the chain 92 is such that it will exceed the rate of withdrawal of the cutter head module 10 from the mined hole 74. In this manner, rocks engaged by the bits 95 will be advanced while the head is being withdrawn. Preferably, the speed of the bits 95 with respect to the housing 60 will exceed by more than two times the maximum speed of withdrawal of the cutter head module 10 from the mined hole 74. In this way, the rotary movement of the rocks 79 which may possibly result as rocks of large size are trapped between the bits 95 and the opposing wedge surface 86 are rotated toward the hole 82 at a rate faster than the housing 60 moves with respect to the roof 72.

Figure 7:
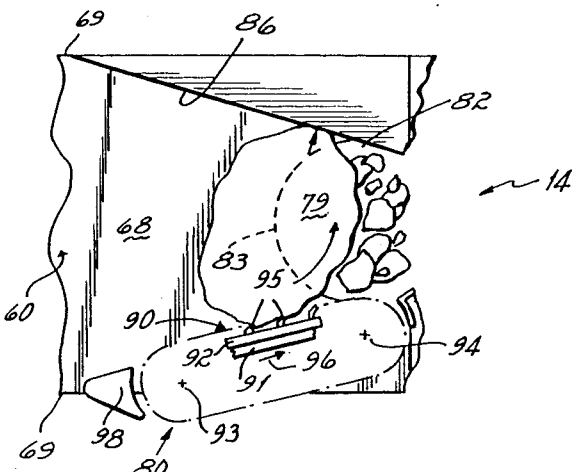
FIG. 7 is a diagram in top view illustrating the operation of one preferred embodiment of the rock removal portion of the apparatus of FIG. 1.

The rock crushing action of the assembly 90 is caused by the rotation of rocks trapped between the bits 95 on the chain 92 and the opposed inclined and fixed surface 86. The surface 86 is of strong and durable steel rigidly secured to the strong housing 68 so that it will resist without being damaged, the urging of rocks against it by the advancement of the crusher bits 95. The normal flexing of chain 92 is prevented by the "back-up" plate or brace 91. The subsequent crushing effect of these opposed rigid structures is more particularly illustrated in the diagram of FIG. 7. As there shown, the advancing and binding of the rock 79 between the surface 86 and the chain 92 causes the rock to fracture and these pieces to drop into the hole 82.

Also included in the rock crushing assembly 90 is a fender 98 which is rigidly fixed to the upper housing surface 68 and positioned behind (upstream when the equipment is being withdrawn from the mined hole 74) to protect the chain 92 and other components of the crusher assembly 90 upon withdrawal of the equipment from the hole 74.

Figure 8:
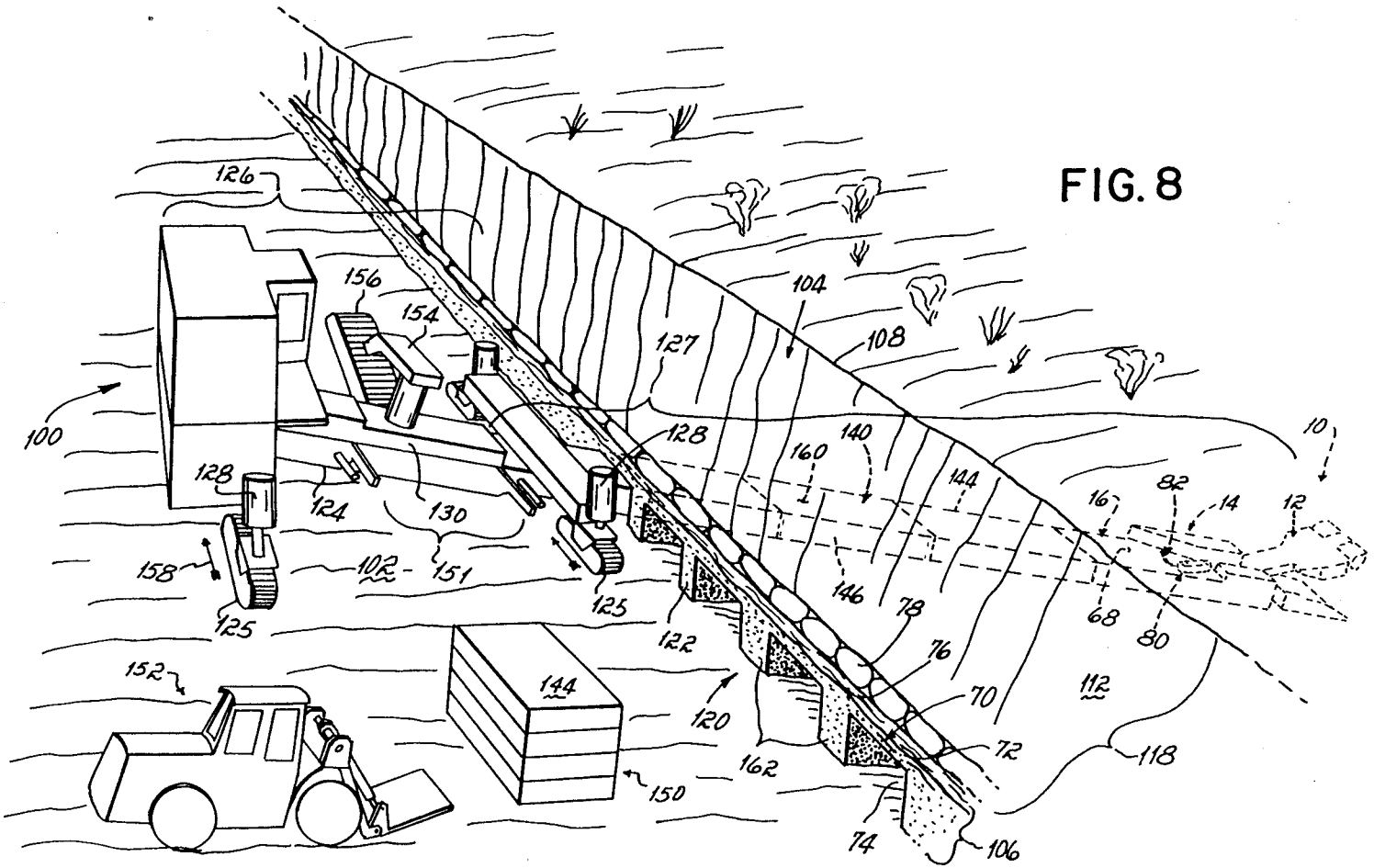
FIG. 8 is a perspective view of a highwall mining machine provided with the cutter head module and roof rock removal apparatus according to the embodiment of the invention illustrated in FIG. 1.

The overall construction of a highwall mining machine 100 embodying the present invention is illustrated in FIG. 8. The highwall mining machine 100 is a remote control mining machine for mining coal from the bench or surface area 102. The bench or surface area 102 will, in many cases, involve a pit 104 which remains after the completion of the strip mining of a coal seam. The floor of this pit 104 is generally referred to as a bench 102. The bench 102 is the top of the geological layer which formerly had underlied a coal seam 106 which had been partially removed, and is often the exposed upper surface of the extension of the rock strata immediately underlying the seam 106, forms the platform from which the seam is mined. A surface mining operation usually will have been undertaken to remove a seam 106 of coal. The surface mining operation will have involved the excavation of dirt and rock from a grade level 108 down to the upper surface 70 of a coal seam 106. The ultimate objective of the surface mining operation is the removal of the coal contained in the seam 106.

In the surface mining operation, it is necessary to remove surface soil 112, layers of sandstone, limestone or whatever other hard rock 78 is present, and a seam roof forming layer of sedimentary rock, which is often found to be slate or shale 72, immediately overlying the seam 106. The entire overburden 118 which is made up of the layers 72, 78 and 112 will have been removed first by excavation in this surface mining process and kept separate from the subsequently mined coal. Then, the coal seam 106 is removed.

The valuable product of the operation is, of course, the coal taken from the seam 106 In strip mining, the cost per ton of the coal removed by the mining of the seam 106 includes the cost of removal of the overburden 118 in addition to removal of the coal seam 106 itself. The coal seam will usually be found to extend deeper and deeper into the ground or beneath a mountain such that the overburden thickness 118 becomes too great, and the cost of its removal then becomes too great, to proceed with the surface mining operation. In such an event, the cost of the resulting product of the coal mined from the seam 106 is not justified by the value of the amount of coal removed. At this point, highwall mining equipment has been found to be economically effective in removing additional and heretofore unmovable coal. A highwall mining machine such as the machine 100 is that disclosed in detail in Todd Reissue Pat. No. 31,622, incorporated herein.

The termination of the surface mining operation will have left what is referred to as a highwall 120. A highwall 120 is the face of the excavation which includes an outcrop 122 of the coal seam 106 and the overburden 118 above it. The outcrop 122 of the coal seam 106 will typically be at the base of the highwall 120. Highwall mining is the practice of removing coal from the seam outcrop 122 at the highwall 120. Highwall mining through the use of a thin seam or highwall mining machine 100 is one of the methods by which highwall mining is accomplished and the one to which the present invention is must valuable.

The highwall mining machine 100 is provided with a base or baseframe 124 which is designed to be moved by a track drive system 125 on the bench 102 along the outcrop 122 of the seam 106 and positioned adjacent the seam 106. The baseframe 124 supports the surface unit 126 of the mining machine 100 from which extends the cutter string portion 127 of the machine 100. The cutter string 127 includes the cutter head module 10, which enters the mined hole 74, and usually one or more pushbeam sections which extend the length of the cutter string 127. When the surface unit 126 is positioned, the weight of the baseframe 124 is capable of firmly anchoring to the bench 102 with sufficient firmness to apply thrust to the portion 127 of the machine 100 extending into the mined hole 74.

The track or crawler drive system 125 includes four individually steerable and controllable crawler assemblies which can raise and lower the frame 124 which carries the machine. The crawlers are attached to the frame 124 by vertically movable hydraulic cylinders 128 mounted to the base 124 and the crawlers 125. The base frame 124 comprises a longitudinal set of rails which are directed toward the coal seam 106. The rails are oriented by the crawlers 125 parallel to the top of the bench 102 and to the last adjacent mined hole, if any. The first mined hole is set with a heading usually established by a cite survey. The frame 124 may be raised, lowered, leveled or tilted by an operation of the cylinders 128 so as to produce a desired initial hole.

Supported on the frame 124 is a power head 130. The power head 130 carries an electric or hydraulic ram (not shown) arranged to push or pull the cutter head with several hundred pounds of force, for example 275,000 lbs., in either the forward or backward direction. The ram will exert compressive force toward the highwall 120 to drive the cutting head module 10 into the seam 106 either directly or through an intervening multi-section pushbeam string 140. The head 130 will also operate in reverse to pull the module 10 any pushbeam 140 from the highwall 120.

Figure 4:
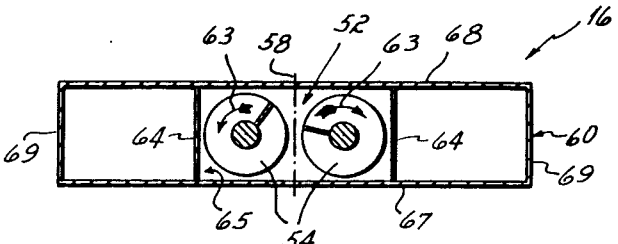
FIG. 4 is a cross-sectional view along lines 4—4 of FIG. 2.

An important part of the mining machine 100 is the multi-section pushbeam string 140. The pushbeam string 140 and the cutter head module 10 make up the portion 127 of the machine 100 which enters the mined hole 74. The pushbeam string 140 includes a plurality of identical pushbeam sections 144 each of which carries, at each end, means for securing each section of the pushbeam 144 to and adjacent the pushbeam section 144 or to the rearward end of the cutter head module 10 of FIG. 1 or to the forward end of the power head 130. In transverse cross-section, each of the pushbeam sections 144 is a box-like column similar to that of the rear section 16 of the cutter head module 10 housing within it the forwardmost section of the horizontal auger conveyor 52 as shown in FIG. 4 which extends through the additional pushbeams 144. The rearmost pushbeam section 144 engages the ram of the power head 130. The power head 130 supports motors and gearboxes which drivably engage the rearmost end of the conveyor 52 to drive it at 131 r.p.m. Each beam section 144 has a housing 146 which forms one section of a compressive column extending from the housing 60 of the cutter head module 10 to the driving ram of the power head module 130. The horizontal auger conveyor 52 extends the entire length of the pushbeam 140 from the rear section 16 of the cutter head module 10 to the power head 130. The power head 130 carries auger driving means (not shown) which engage and rotate the augers 54 of the horizontal auger conveyor 52.

The ram or power head thrusting means of the power head 130 operates to drive the pushbeam 140 inwardly into the coal seam 106 from along the frame 124 thus exerting force to push the cutter drum 30 of cutter head module 10 against the forward face of the coal seam 106. This force enables the cutter drum 30 to mine coal and to cut the mined hole 74 into the coal seam 106. This cutting operation advances the module 10 and the entire assembled pushbeam string 140 into the mined hole 74. Each time the cutter head module 10 advances the length of one pushbeam 144 into the coal seam 106, the drive means on the power head 130 is disconnected from the cutter string and retracts to allow the insertion of another pushbeam section 144 from a pushbeam supply stack 150 onto the frame 124 rearward of the last pushbeam section 144 or, if none, the cutter head module 10.

The loading is accomplished with a pushbeam transfer mechanism 151 which includes a hydraulically operated table and swingarm which receives or delivers pushbeam sections 144 from a loader 152 which transfers the sections 144 between the stack 150 and the transfer mechanism 151. The transfer of pushbeam sections 144 from the stack 150 to and from the mechanism 151 is accomplished through the use of the loader 152 situated at the bench 102.

In operation, the mining machine 100 will have advanced the cutter head module 10 to its maximum practical distance into the coal seam 106 before the ram of the power head 130 then must reverse to withdraw the cutter string 127, including the pushbeam string 140 made up of the pushbeam sections 144, and cutter head module 10 from the mined hole 74. During the advance of the equipment into the seam 106, mined coal is constantly conveyed to the surface 102 through the conveyor 52. This coal is discharged at the power head end of the pushbeam string 140 through a discharge mechanism 154 to a loading system 156 from which it is ultimately transferred onto the ground or into trucks or other coal hauling equipment which will remove the coal from the mining site.

The removal of the cutter string 127 from a mined hole 74 proceeds by a withdrawal of the pushbeam string 140 from the hole 74 by the removal, one at a time, of each of the pushbeam sections 144, and then ultimately the removal of the cutter head module 10. When this has been achieved, the machine 100 is moved by operation of the drive system 125 in the direction 158 on the bench 102 across the face of the outcrop 122 of the highwall 120. The process is then repeated so that another mined hole is begun parallel to, adjacent to, and spaced from, the previously completed mined hole 74.

As a result, a series of mine holes 74 will have been left in the coal seam 106. Each of these holes 74 is separated by a rib or block 159 which supports the remaining overburden 118. The rib 159 will be typically three or four feet wide, but may be of any width sufficient to support the overburden, but not unnecessarily thick so as to leave excessive unmined coal. The mining process continues until the maximum amount of coal has been withdrawn.

When upon the attempt to remove the mining equipment 100 from the mined hole 74, portions of the roof material which overlies the mined hole from layer 72 will fall upon the pushbeam 140 or cutter head 10. While this coal is being transported by the conveyor 52, the partition 68 of the cutter head 10 maintains separate from the conveyed coal any fallen roof material which rests upon the module 10. On the pushbeam 140, the upper surface 160, which is an extension of the portion 68 performs the same function. Roof rock which falls upon the upper surface 160 of the beam column 140 may snag on the irregular roof of the mined hole 74 and eventually accumulate on the co-planar upper surface 68 of the housing 60 of the cutter head module 10. As this occurs, rather than a jam resulting as with the prior art, this rock is removed through the use of the roof rock removal assembly 80 according to principles of the present invention.

Figure 9:
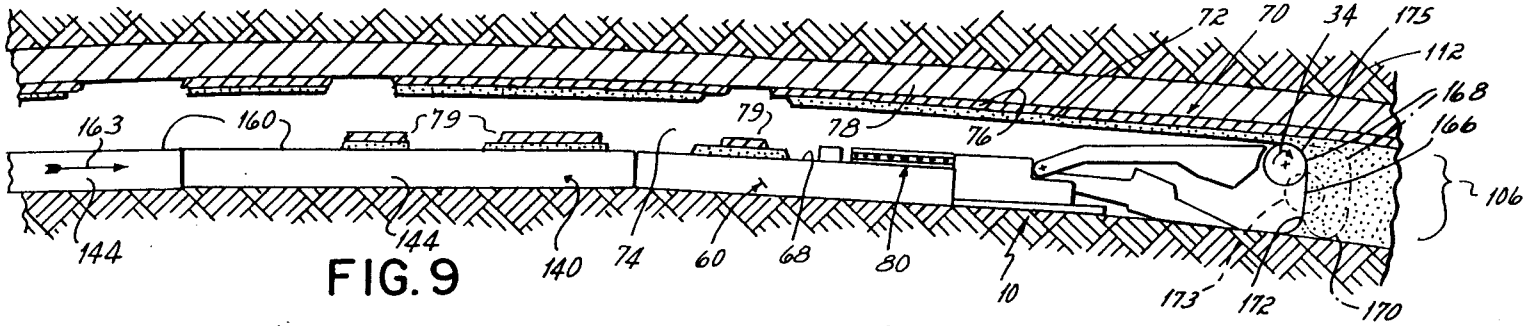
FIG. 9 is a cross-sectional elevational diagram illustrating the highwall mining machine of FIG. 5 advancing forward into the coal seam.
Figure 10:
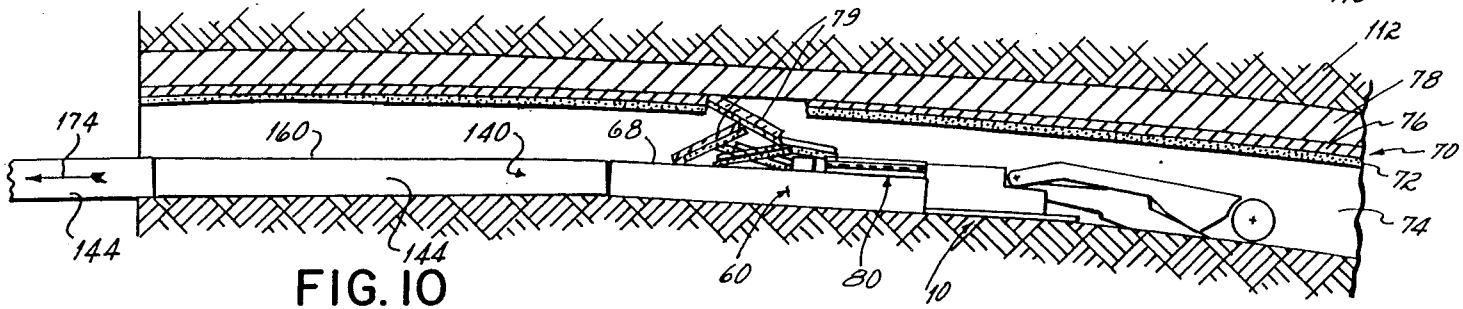
FIG. 10 is a drawing similar to FIG. 9 showing the fallen roof rock accumulating against the rock removal upon retraction of the mining machine from the seam.
Figure 11:
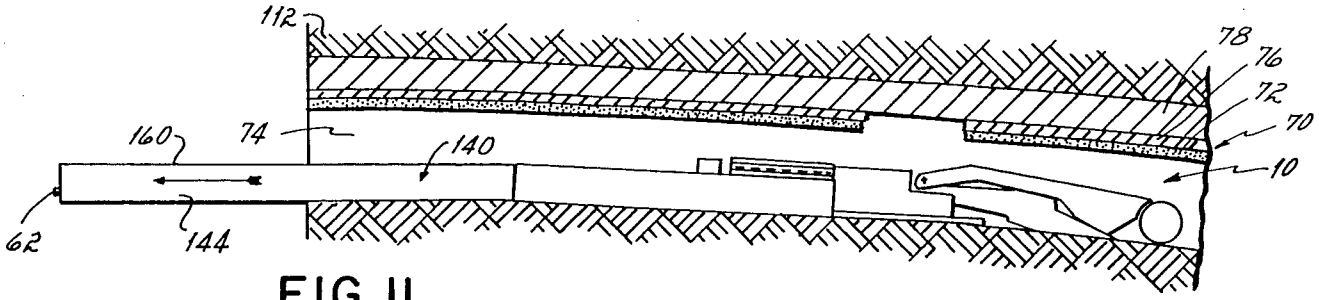
FIG. 11 is a drawing similar to FIG. 10 showing the rock removal feature of the present invention in operation in the process of clearing accumulated roof rock from the mineral hole.

The problem caused by this roof fall, and its removal according to the present invention, is illustrated by FIGS. 9–11 which shows the operation of the equipment during removal from the mine seam. Referring to FIG. 9, the advancing cutter head module 10 is illustrated.

During this advancing or mining phase, the equipment is thrust into the coal seam 106 by compressive force presented by the arrow 163 to the left of the figure. This force is transmitted through each of the pushbeam sections 144 of the pushbeam 140 and against the cutter head module 10. This causes the module to exert pressure against the face 166 of the coal in the seam 106. There are several cutting or sumping patterns which are employed in advancing the cutter head 10 into the seam. One process similar to that used in continuous mining is the cycle of raising the cutter head boom 20 to such a height that it is up to or just below the upper edge of the coal seam 106. The cutter drum 30 thereupon rotates in the direction shown by the arrow 34 and cuts into the coal seam at the point 168. The boom 20 is then lowered to cut the remaining cut 170 in the coal seam 106. This often leaves the small portion of coal 172. This is removed by moving the entire machinery outwardly slightly by pulling the pushbeam 140 at the power head 130 as shown by the force of the arrow 174. This moves the cutter head module 10 backwards slightly to position 173 to cut out the portion of coal 172 leaving a clean lower surface to the mine hole 74. Then the cutter head is raised to position 175 and the cycle continues by advancing the module 10 forward again to remove additional coal. The preferred cycle for use in highwall mining entails an advance or sumping in at the top, shearing down, sumping in again the bottom of the hole and then shearing up. The rate of mining of the hole 74 may be in the order of one to five feet per minute according to this process.

During this mining process, the coal is scooped by the gathering mechanism 40 transported by the gathering conveyor 50 into the auger conveyor 52 within the rear section 16 of the cutter head module 10. The coal during this advancing and mining sequence is continuously moved through the conveyor 52 to the surface. It will be seen that, as illustrated in FIG. 9, plates of shale or other overburden rock 79 will have fallen upon the pushbeam 140 and remain resting on surfaces 160 of the pushbeam 140.

Upon the reaching of a maximum extent by head module 10, the equipment is then withdrawn from the hole. The upper surface of the pushbeam 140, namely surface 160 and the upper surface 68 of the rear section 16 of the cutter head module 10 supports the fallen rock and maintains it separated from the coal which is being transmitted through the conveyor 52 beneath the surfaces 160 and 68. The upper surface 72 of the mined hole 74 is irregular, however, and as the equipment is withdrawn from the hole in the direction 174 illustrated in FIG. 10, it may occur that the fallen rocks 79 will jam against portions of the roof and thus be prevented from moving from the mined hole along with the equipment. The continued progressive withdrawal of the mining equipment with force exerted by the power head in the direction of the arrow 174 will eventually cause the rocks 79, or some of them, to jam against the roof 72 and slide forward onto the surface 68 of the mining head module 10. These rocks will then bunch up and bind against the rock removal assembly 80, instead of the higher portions of the cutter head module 10, and interrupts a relative path of movement on the smooth surface 160 and 68 toward the cutter head assembly 10. As a result, the situation illustrated in FIG. 10 will occur. When this occurs, the operator at the surface 102 will detect an increase in resistance to the withdrawal of the equipment by the power head 130. This will or may ultimately result in a complete halting of the operation of withdrawing the beam 140 from the hole 74. When this occurs, the operator energizes the rock removal apparatus 80. This causes the rocks which have been urged against the assembly 80, and which appear between the upstanding guides 86 and (87 or 90) to be guided into the hole 82.

If the embodiment shown in FIG. 6 is employed, the fixed guide members 86 and 87 will be relied upon to guide the rocks into the hole 82 solely by the guiding surfaces 86 and 87 delivering the fallen roof material to the conveyor. In the embodiment shown in FIGS. 1–3, however, power assist means are employed as for example the mechanism 90 to advance, rotate, and ultimately crush the oversized rocks against the member 86 as illustrated in connection with FIG. 7. With this mechanism, the rocks 79 are crushed and pushed into the opening 82 as the modules are withdrawn from the seam. This proceeds until the rock which is causing the jam has been effectively removed and the situation is then such as that shown in FIG. 11. In this manner, the equipment that continues to be withdrawn from the mined hole 74.

The rock which has been channeled into the opening 82 during this process falls into the conveyor 52 which is energized for sufficient duration to draw the rock into the forward end of the conveyor 52 and advance it, crushing it sufficiently to facilitate each transport through the conveyor 52. Further, breaking of the rock will be caused by the crushing bits 57 on the augers 54. These bits 57 are present on the feed side of the augers 54 in the rear section 16 of the cutter head module 10 in the area below hole 82. In removal of the roof fall material, this rock is transported away from the jamming site without mixing with the coal. This is due to the fact that the rock is removed during a period of time when no coal is being transported. As such, it is possible to keep the coal separate from the rock and thus avoid contamination of the coal while allowing the use of the same augers and same conveyor to remove both the rock and the coal.

Having fully described the invention, the following is claimed:

1. A thin-seam highwall mining machine comprising:

a power head adjusted to be disposed adjacent the face of a coal seam at a highwall;

a cutter head operable to mine coal from the seam by cutting a mined hole while advancing longitudinally into the coal seam when forwardly thrust toward the face of the seam;

a multi-section pushbeam extending from said power head to said cutter head and connected at its forward end to said cutter head, said pushbeam having therein a material removal conveyor operable to convey material directed into said conveyor to the surface at the highwall;

means carried by said cutter head for directing coal mined by said cutter head into said conveyor when said cutter head is advancing forwardly into the mined hole;

said power head being connected to the rearward end of said pushbeam for alternatively thrusting said pushbeam and said cutter head forwardly into, and drawing said pushbeam and said cutter head rearwardly from, the mined hole;

said pushbeam having a partition on the upper side thereof for supporting rock fallen from the roof of the mined hole and for maintaining the fallen rock separate from the coal being conveyed when the cutter head is advancing into the seam; and means carried by said pushbeam for directing fallen roof rock supported by said partition into said conveyor when said pushbeam and said cutter head are being withdrawn from the mined hole.

2. The machine of claim 1 in which the dimension of said cutter head from side to side is substantially greater than its vertical dimension, and the dimension of said pushbeam is substantially greater from side to side than its vertical dimension.

3. The machine of claim 2 in which the vertical dimension of said cutter head is greater than the vertical dimension of said pushbeam.

4. The machine of claim 2 wherein said fallen roof rock directing means comprises:

a pair of guide members secured to and upstanding from said partition, said guide members each having a forward end proximate the forward end of said conveyor, said guide members forming a rearwardly diverging V-shape, each having a rearward end proximate a respective one of the opposite sides of said partition.

5. The machine of claim 1 wherein:

said partition has an opening therein proximate the forward end of said conveyor; and said fallen roof rock directing means is operable to direct the fallen roof rock from said partition through said opening when said pushbeam and said cutter head are being withdrawn from the mined hole.

6. The machine of claim 5 wherein said fallen roof rock directing means comprises:

a pair of rearwardly diverging guide members secured to and upstanding from said partition, said guide members each having a forward end proximate said opening.

7. The machine of claim 6 wherein:

said upstanding guide members include a fixed guide member having a rearward end near one side of said partition and a forward end near said material removal conveyor, and the other of said guide members comprises said rock directing conveyor, the rearward end of which is near the other side of said partition and the forward end of which is near said material removal conveyor, said rock directing conveyor being operable to rotate, advance and crush rock between said guide members.

8. The machine of claim 1 wherein said fallen roof rock directing means comprises:

a pair of upstanding guide members at least one of which includes a rock directing conveyor mounted on said partition, and means carried by said pushbeam for advancing said rock directing conveyor to move fallen roof rock forwardly along said partition into the forward end of said material removal conveyor when said pushbeam is being withdrawn from the mined hole.

9. The machine of claim 1 wherein said material removal conveyor includes a pair of counter rotating augers.

10. The machine of claim 9 wherein said augers each have near the forward end thereof a plurality of rock crushing bits thereon.

11. A mining machine comprising:

a cutter head operable to mine material from a mined seam by cutting a hole while advancing forwardly into the seam;

a conveyor assembly connected at its forward end to said cutter head, said assembly comprising a box-like column having a conveyor housed therein, said conveyor being operable to convey therethrough material which has been directed into said conveyor;

means carried by said cutter head for directing material mined by said cutter head into said conveyor when said cutter head is advancing forwardly into the seam;

a partition on the upper side of said box-like column for supporting material fallen from the roof of the mined hole and maintaining the fallen rock separate from mined material being conveyed by said conveyor when the cutter head is advancing into the seam; and means carried by said conveyor assembly for directing fallen roof material supported by said partition into said conveyor when said assembly and said cutter head are being withdrawn from the mined hole.

12. A thin-seam highwall mining machine comprising:

a power head disposable adjacent to the face of a coal seam at a highwall;

a cutter head;

a pushbeam extending between said power head and said cutter head, said beam being connected at its forward end to said cutter head, said pushbeam having a material removal conveyor housed therein for conveying material toward said bench;

said power head being drivably connected to the rearward end of said pushbeam for alternatively thrusting said pushbeam and said cutter head forwardly into, and pulling said pushbeam and said cutter head rearwardly from, the seam;

a partition formed on the upper side of said pushbeam; and a pair of rearwardly diverging guide members secured to and upstanding from said partition, said guide members each having a forward end proximate the forward end of said conveyor and each having a rearward end spaced from the rearward end of the other of said members across the width of said pushbeam.

13. The machine of claim 12 wherein:

said partition has an opening therein proximate the forward end of said guide members.

14. The machine of claim 13 wherein at least one of said guide members includes a rock directing conveyor mounted on said partition and having a conveying surface facing the other of said members, and means carried by said pushbeam for advancing the conveying surface of said rock directing conveyor forwardly toward said opening.

15. The machine of claim 14 wherein said rock advancing conveyor has bits carried thereby for breaking rock between said members as said rock advancing conveyor surface is advanced.

16. The machine of claim 12 wherein said material removal conveyor includes a pair of counter rotating augers.

17. The machine of claim 16 wherein said augers each have near the forward end thereof a plurality of material breaking bits thereon.

18. A mining machine comprising:

a cutter head operable to mine coal from a coal seam by cutting a mined hole while longitudinally advancing forwardly into the coal seam;

a conveyor assembly connected at its forward end to said cutter head, said conveyor assembly being movable to advance behind said cutter head longitudinally into the mined hole and being withdrawn ahead of said cutter head longitudinally from the mined hole, said assembly having housed therein a material removal conveyor operable to convey rearwardly material directed into said conveyor;

means for directing coal mined by said cutter head into said conveyor when said cutter head is advancing forwardly into the mined hole;

said conveyor assembly having a partition fixedly mounted on the upper side thereof for supporting rock fallen from the roof of the mined hole and for maintaining the fallen rock separate from the coal being conveyed when the cutter head is advancing into the seam; and means carried by said conveyor assembly for directing fallen roof rock supported by said partition into said conveyor when said assembly and said cutter head are being withdrawn from the mined hole.

19. The machine of claim 18 wherein:

said partition has an opening therein proximate the forward end of said conveyor assembly; and said fallen roof rock directing means is operable to direct the fallen roof rock from said partition through said opening when said assembly and said cutter head are being withdrawn from the mined hole.

20. The machine of claim 19 wherein said fallen roof rock directing means comprises:

a pair of guide members secured to and upstanding from said partition, said guide members each having a forward end proximate said opening and each having a rearward end spaced from the rearward end of the other of said members so as to span the width of said assembly.

21. The machine of claim 20 wherein said guide members form a rearwardly diverging V-shape having their forward ends terminating near said opening.

22. The machine of claim 20 wherein at least one of said guide members includes a rock directing conveyor mounted on said partition and having a conveying surface facing the other of said members, and means carried by said conveyor assembly for advancing the conveying surface of said conveyor forwardly toward said opening.

23. The machine of claim 22 wherein said rock advancing conveyor has bits carried thereby for advancing and breaking rock between said members as said rock advancing conveyor surface is advanced.

24. The machine of claim 20 wherein said material removal conveyor includes a pair of counter rotating augers.

25. The machine of claim 24 wherein said augers each have near the forward end thereof a plurality of rock breaking bits thereon.

26. A method of mining coal from a seam at a highwall comprising the steps of:

advancing a cutting head forwardly into the seam by exerting compressive force against the rear of the cutting head through a pushbeam from the highwall such that the pushbeam follows the cutting head forwardly into the seam;

conveying mined coal through a conveyor housed within said pushbeam while the cutting head is being advanced;

supporting above the pushbeam roof rock which falls upon the pushbeam, and maintaining the fallen rock separate from the conveyed coal as the cutting head is being advanced;

withdrawing the cutting head and pushbeam from the coal seam by pulling the pushbeam rearwardly at the highwall to draw the pushbeam followed by the cutting head rearwardly from the seam;

directing the separated fallen rock supported upon the pushbeam into the conveyor and conveying the fallen rock through the conveyor as the pushbeam and cutter head are being withdrawn from the seam.

27. The method of claim 26 wherein said rock directing step comprises the step of:

directing the fallen rock through an opening on the upper surface of the pushbeam to the forward end of the conveyor.

28. The method of claim 26 wherein said rock directing step comprises the step of:

passively guiding fallen rock into an opening on the upper surface of the pushbeam.

29. The method of claim 26 wherein said rock directing step comprises the step of:

actively advancing rock along the upper surface of the pushbeam to the forward end of the conveyor.

30. The method of claim 29 wherein the rock advancing step further comprises the step of rotating the rock as it is being advanced.

31. The method of claim 29 wherein the rock advancing step further comprises the step of breaking the rock as it is advanced.

* * * * *

UNITED STATES PATENT AND TRADEMARK OFFICE

CERTIFICATE OF CORRECTION

PATENT NO. : 4,953,915

DATED : September 4, 1990

INVENTOR(S) : Manfred Jasser, et al.

It is certified that error appears in the above-identified patent and that said Letters Patent is hereby corrected as shown below:

Column 5, line 63, after "rock removal" insert --apparatus--.

Column 16, line 25, Claim 4 "claim 2" should be --claim 1--.

Signed and Sealed this

Twelfth Day of May, 1992

*Attest:*

DOUGLAS B. COMER

*Attesting Officer*

*Acting Commissioner of Patents and Trademarks*